US008046121B2

(12) United States Patent
Mizutani

(10) Patent No.: US 8,046,121 B2
(45) Date of Patent: Oct. 25, 2011

(54) WATERCRAFT STEERING DEVICE AND WATERCRAFT

(75) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 978 days.

(21) Appl. No.: 11/942,159

(22) Filed: Nov. 19, 2007

(65) Prior Publication Data

US 2008/0125925 A1 May 29, 2008

(30) Foreign Application Priority Data

Nov. 17, 2006 (JP) ..... 2006-312184

(51) Int. Cl.
*B60L 3/00* (2006.01)
*B60L 15/00* (2006.01)

(52) U.S. Cl. ..... 701/21; 701/11; 701/41; 701/42; 701/43; 114/144 R; 114/155; 114/156; 114/157; 114/158; 114/159; 114/144 A

(58) Field of Classification Search ..... None
See application file for complete search history.

(56) References Cited

U.S. PATENT DOCUMENTS

| | | | |
|---|---|---|---|
| 2,215,003 | A | 9/1940 | Johnson |
| 2,224,357 | A | 12/1940 | Pecker |
| 3,084,657 | A | 4/1963 | Kiekhaefer |
| 3,233,691 | A | 2/1966 | De Biasi |
| 3,310,021 | A | 3/1967 | Shimanckas |
| 3,349,744 | A | 10/1967 | Mercier et al. |
| 4,120,258 | A | 10/1978 | Spurgin |
| 4,220,111 | A | 9/1980 | Krautkremer et al. |
| 4,373,920 | A | 2/1983 | Hall et al. |
| 4,500,298 | A | 2/1985 | Hall et al. |
| 4,519,335 | A | 5/1985 | Krautkremer et al. |
| 4,637,802 | A | 1/1987 | Taguchi et al. |

(Continued)

FOREIGN PATENT DOCUMENTS

JP 57-030698 A 2/1982

(Continued)

OTHER PUBLICATIONS

Official Communication issued in corresponding European Patent Application No. 07022320.1, mailed on Apr. 27, 2011.

(Continued)

*Primary Examiner* — Khoi Tran
*Assistant Examiner* — Bhavesh V Amin
(74) *Attorney, Agent, or Firm* — Keating & Bennett, LLP

(57) ABSTRACT

A watercraft steering device can include at least one of steerage status detection device configured to detect a steerage status following an operation of the steering wheel, running status detecting device configured to detect a running status of the watercraft, watercraft propulsion unit status recognition device configured to recognize a status of an outboard motor such as an installation number thereof, and electric motor status detection device configured to detect a status of an electric motor, and can further include a lower unit turning force characteristic computation device configured to compute a lower unit turning force characteristic based on a detection value from at least one of the device, and an ECU configured to control at least one of a reaction force to the steering wheel, a limit lower unit turning angle, and a propulsive force based on a computed lower unit turning force characteristic and/or selecting the electric actuator to operate.

11 Claims, 13 Drawing Sheets

U.S. PATENT DOCUMENTS

| | | | | |
|---|---|---|---|---|
| 4,787,867 | A | 11/1988 | Takeuchi et al. | |
| 4,872,857 | A | 10/1989 | Newman et al. | |
| 4,908,766 | A | 3/1990 | Takeuchi | |
| 4,909,765 | A | 3/1990 | Riske et al. | |
| 5,029,547 | A | 7/1991 | Novey | |
| 5,031,562 | A | 7/1991 | Nakase et al. | |
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,589 | B2 * | 1/2004 | Robertson et al. | 701/21 |
| 6,678,596 | B2 | 1/2004 | Husain et al. | |
| 6,843,195 | B2 | 1/2005 | Watabe et al. | |
| 6,855,014 | B2 | 2/2005 | Kinoshita et al. | |
| 6,892,661 | B2 | 5/2005 | Kishi et al. | |
| 6,892,662 | B2 | 5/2005 | Watanabe et al. | |
| 6,994,046 | B2 | 2/2006 | Kaji et al. | |
| 6,997,763 | B2 | 2/2006 | Kaji | |
| 7,004,278 | B2 | 2/2006 | Sugitani et al. | |
| 7,063,030 | B2 | 6/2006 | Mizutani | |
| 7,140,315 | B2 * | 11/2006 | Okuyama | 114/144 R |
| 7,143,363 | B1 * | 11/2006 | Gaynor et al. | 715/771 |
| 7,156,034 | B2 | 1/2007 | Mizutani | |
| 7,267,069 | B2 | 9/2007 | Mizutani | |
| 7,267,587 | B2 | 9/2007 | Oguma et al. | |
| 7,270,068 | B2 | 9/2007 | Mizutani | |
| 2003/0077953 | A1 | 4/2003 | Kaji | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 | 6/2005 | Gronau et al. | |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0282447 | A1 | 12/2005 | Okuyama | |
| 2006/0019558 | A1 | 1/2006 | Mizutani et al. | |
| 2006/0037522 | A1 | 2/2006 | Kaneko et al. | |
| 2007/0049139 | A1 | 3/2007 | Mizutani | |
| 2007/0066154 | A1 | 3/2007 | Mizutani | |
| 2007/0066156 | A1 | 3/2007 | Mizutani | |
| 2007/0066157 | A1 | 3/2007 | Yamashita et al. | |
| 2007/0093147 | A1 | 4/2007 | Mizutani | |
| 2007/0105463 | A1 | 5/2007 | Mizutani | |

FOREIGN PATENT DOCUMENTS

| | | | |
|---|---|---|---|
| JP | 62-166193 | | 7/1987 |
| JP | 01-314695 | | 12/1989 |
| JP | 02-179597 | | 7/1990 |
| JP | 02-227395 | | 9/1990 |
| JP | 03-148395 | | 6/1991 |
| JP | 04-038297 | | 2/1992 |
| JP | B-HEI 6-33077 | | 5/1994 |
| JP | 2739208 | B2 | 1/1998 |
| JP | 10-226346 | | 8/1998 |
| JP | A-HEI 10-310074 | | 11/1998 |
| JP | 2959044 | B2 | 7/1999 |
| JP | 2000-313398 | | 11/2000 |
| JP | 2000-318691 | | 11/2000 |
| JP | 3232032 | | 9/2001 |
| JP | A-2002-331948 | | 11/2002 |
| JP | A-2004-155282 | | 6/2004 |
| JP | 2005-254848 | | 9/2005 |

OTHER PUBLICATIONS

Co-Pending U.S. Appl. No. 11/942,179, filed Nov. 19, 2007. Title: Watercraft Steering Device and Watercraft.

Co-Pending U.S. Appl. No. 11/942,187, filed Nov. 19, 2007. Title: Watercraft Steering System, and Watercraft.

* cited by examiner (a)

(b)

(c)

(a)

(b)

WATERCRAFT STEERING DEVICE AND WATERCRAFT

PRIORITY INFORMATION

The present application is based on and claims priority under 35 U.S.C. §119 to Japanese Patent Application No. 2006-312184, filed on Nov. 17, 2006, the entire contents of which are expressly incorporated by reference herein.

BACKGROUND OF THE INVENTIONS

1. Field of the Inventions

The present inventions relate to watercraft steering systems, and more particularly, to such systems having an electric actuator which is actuated as an operator turns a steering member.

2. Description of the Related Art

Japanese Patent Document JP-A-2005-254848 discloses a steering system in which an electric actuator of the steering device is actuated as an operator operates the steering wheel. The watercraft is thus steered in response to the operation amount of the steering wheel.

External forces on the watercraft are also detected. Based on the detected external forces, a reaction torque is applied to the steering wheel. Accordingly, the operator can feel the external force on the watercraft, such as those caused by water currents for example, directly through the steering wheel, and thus can recognize the movement of the watercraft corresponding to such external force to thereby act without delay.

SUMMARY OF THE INVENTIONS

An aspect of at least one of the embodiments disclosed herein includes the realization that in such conventional watercrafts, a reaction torque is applied to the steering wheel based on an external force to the watercraft. An operator can feel the external forces caused by water currents, for example, directly through the steering wheel, and thus can recognize the movement of the watercraft corresponding to the external force, allowing the operator to respond quickly. When the watercraft is not under an external force, an operational feel of the steering wheel can be lighter. Unfortunately, in the case where a larger output (a larger deflection torque) is required for steering, for example, when the steering wheel is operated faster, the steering motor (electric actuator) becomes less responsive, resulting in a poor operation feel. In the environment of use of an outboard motor, the steering motor pivots the outboard motor about its pivot axis. As such, the lower unit of the outboard motor (i.e., the part to which the propeller is rotatably mounted and which is normally underwater during operation) is also pivoted.

With reference to FIG. 12, it should be noted that lower unit deflection torque characteristics required for lower unit deflection (required lower unit deflection force characteristics) may change from the state shown by required lower unit deflection force characteristic line A1 to the state shown by required lower unit deflection force characteristic line A2, depending on the characteristics of the watercraft, a lower unit angle, an operation speed, or the like. In such case, a required lower unit deflection force may exceed the limit of the motor, resulting in impaired responsiveness and a poorer operation feel.

Further, as shown in FIG. 13, motor characteristics depend on the surroundings such as temperature. When the temperature becomes higher for example, the motor characteristics can change from the state shown by motor characteristic line B1 (solid line in the figure) to the state shown by motor characteristic line B2 (broken line in the figure). In such cases, since the motor characteristics at higher temperatures provide lower torque, a target lower unit deflection force required may not be obtained, resulting in impaired responsiveness and a poorer operation feel.

Thus, in accordance with an embodiment, a watercraft steering device can comprise a watercraft propulsion unit disposed at a stern of a watercraft, a steering device actuated by an electric actuator for changing a direction in which the watercraft travels, and a steering wheel operable by an operator and electrically connected to the electric actuator to provide an actuation signal corresponding to an operation amount of the electric actuator. The steering device can further comprise at least one of steerage status detection means for detecting a steerage status following an operation of the steering wheel, running status detection means for detecting a running status of the watercraft, watercraft propulsion unit status recognition means for recognizing a status of the watercraft propulsion unit, and electric actuator status detection means for detecting a status of the electric actuator. A lower unit turning force characteristic computation means can be provided for computing a lower unit turning force characteristic based on a detection value from at least one of the means. Additionally, control means can be provided for controlling at least one of a reaction force to the steering wheel, a limit lower unit turning angle, and a propulsive force based on a computed lower unit turning force characteristic and/or selecting the electric actuator to operate.

In accordance with another embodiment, a watercraft steering device can comprise a watercraft propulsion unit disposed at a stern of a watercraft, a steering device actuated by an electric actuator configured to change a direction in which the watercraft travels, and a steering input device operable by an operator and electrically connected to the electric actuator to provide an actuation signal corresponding to an operation amount of the electric actuator. The steering device can further comprise at least one of steerage status detection device configured to detect a steerage status following an operation of the steering wheel, running status detection device configured to detect a running status of the watercraft, watercraft propulsion unit status recognition device configured to recognize a status of the watercraft propulsion unit, and electric actuator status detection device configured to detect a status of the electric actuator. A lower unit turning force characteristic computation device can be configured to compute a lower unit turning force characteristic based on a detection value from at least one of the steerage status detection device, running status detection device, watercraft propulsion unit status recognition device, and the electric actuator status detection device. Additionally, a controller can be configured to control at least one of a reaction force to the steering wheel, a limit lower unit turning angle, and a propulsive force based on a computed lower unit turning force characteristic and/or selecting the electric actuator to operate.

BRIEF DESCRIPTION OF THE DRAWINGS

These and other features, aspects, and advantages of the present inventions are described below with reference to the drawings of preferred embodiments, which embodiments are intended to illustrate and not to limit the present inventions.

DETAILED DESCRIPTION OF THE PREFERRED EMBODIMENT

The figures illustrate a steering system for a watercraft configured in accordance with certain features, aspects, and advantages of at least one of the inventions described herein. The watercraft merely exemplifies one type of environment in which the present inventions can be used. However, the various embodiments of the steering systems disclosed herein can be used with other types of watercraft or other vehicles that benefit from improved steering control. Such applications will be apparent to those of ordinary skill in the art in view of the description herein. The present inventions are not limited to the embodiments described, which include the preferred embodiments, and the terminology used herein is not intended to limit the scope of the present inventions.

Figure 1:
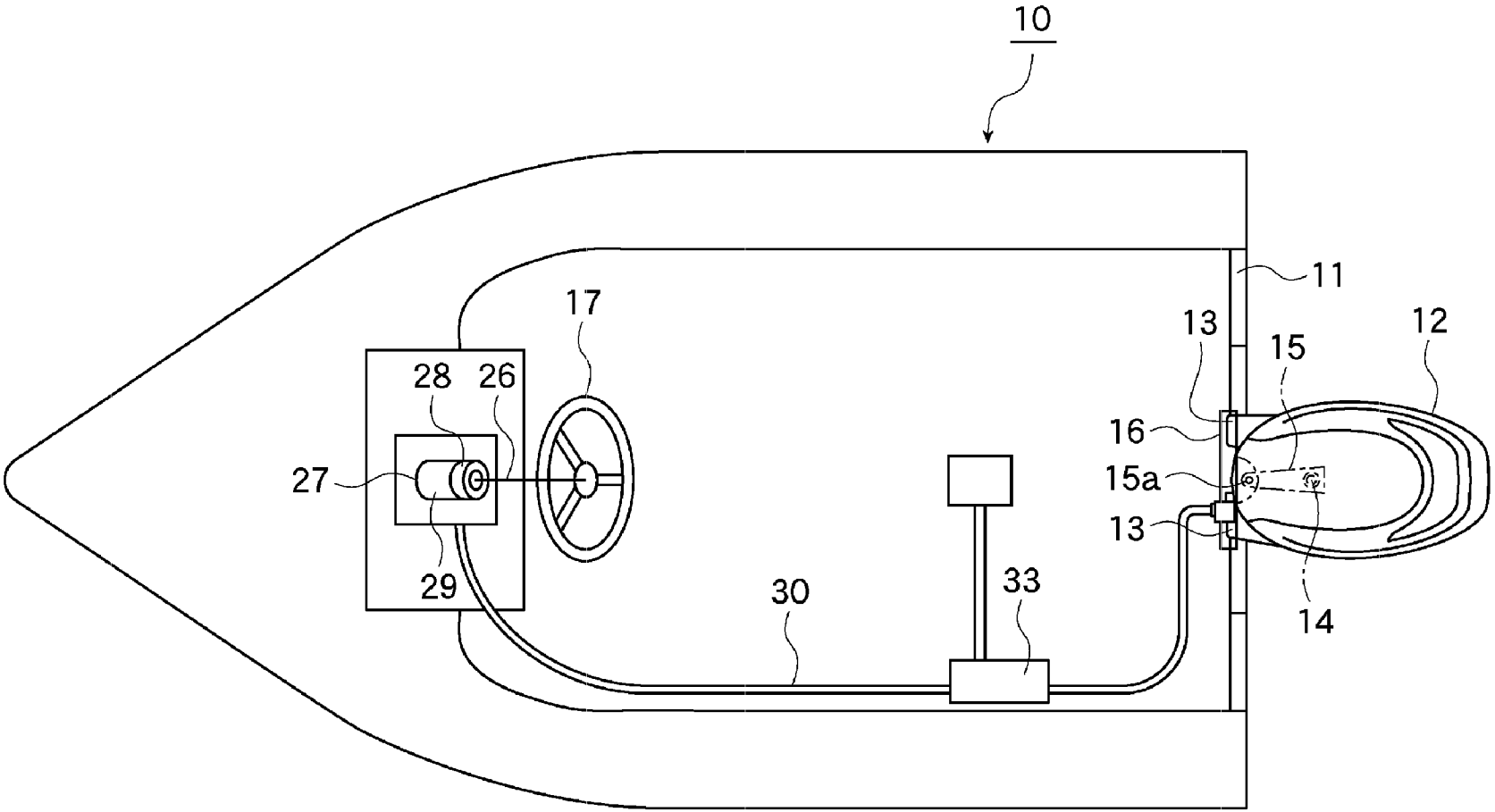
FIG. 1 is a plan view of a watercraft according to an embodiment.

As shown in FIG. 1, a watercraft in accordance with this embodiment can have a hull 10 including a transom 11. To the transom 11, an outboard motor 12, which can serve as a "watercraft propulsion unit", can be mounted via clamp brackets 13. The outboard motor 12 can be pivotable about a swivel shaft (steering pivot shaft) 14 extending in a vertical direction.

A steering bracket 15 can be fixed at the upper end of the swivel shaft 14. The steering bracket 15 can be coupled at its front end 15*a* to a steering device 16. The steering device 16 can be driven by operating a steering wheel 17 disposed in an operator's area.

Figure 2:
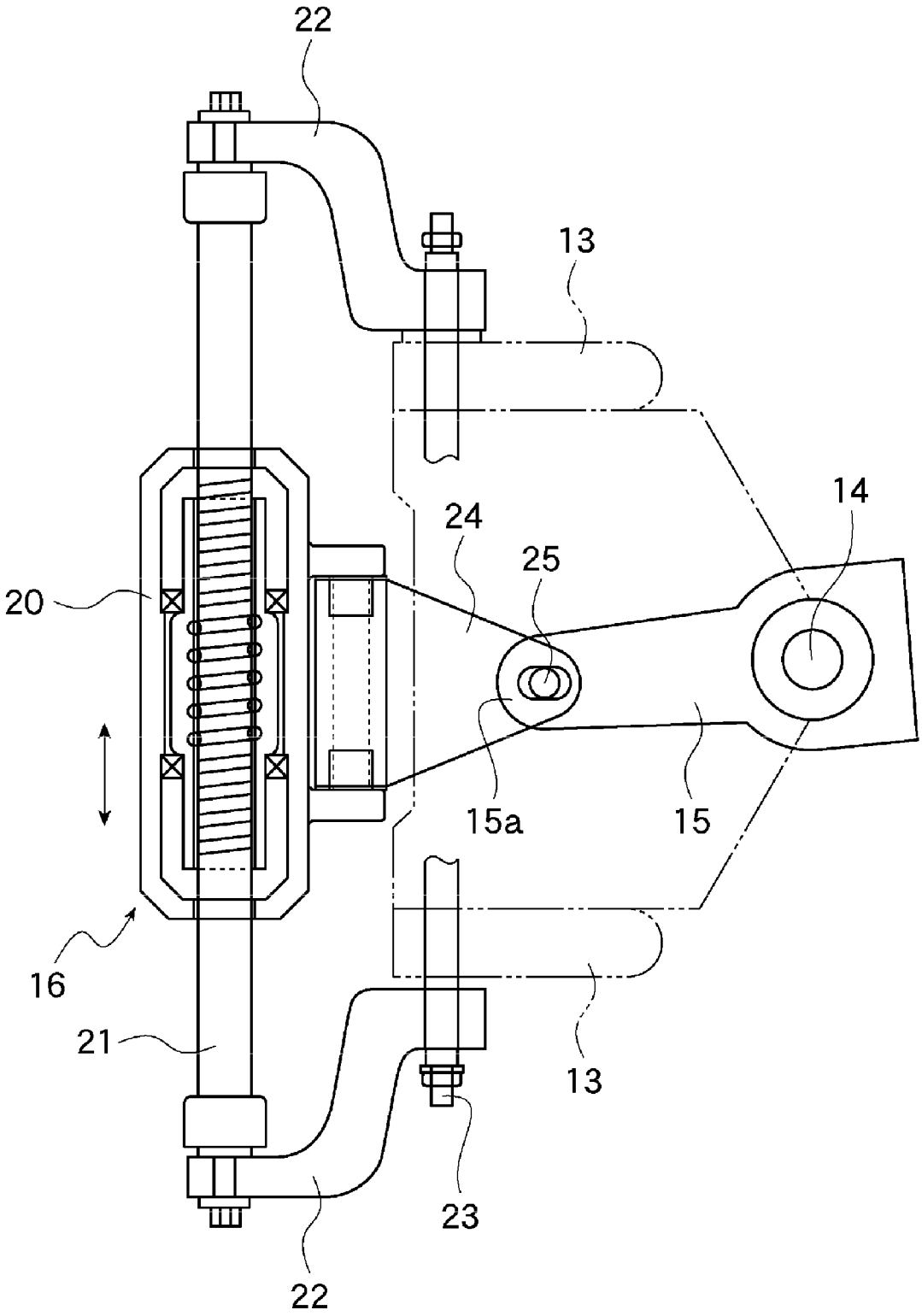
FIG. 2 is an enlarged plan view of a steering device of the watercraft according with the embodiment of the present invention.

As shown in FIG. 2, the steering device 16 can include a DD (direct drive) electric motor 20 for example, as an "electric actuator." The electric motor 20 can be attached to a threaded rod 21 extending in a width direction of the watercraft, and can be movable in the width direction of the watercraft along the threaded rod 21. However, other configurations can also be used.

The threaded rod 21 can be supported at its both ends by a pair of left and right supports 22. The supports 22 can be supported by a tilt shaft 23. The electric motor 20 can have a coupling bracket 24 extending rearwardly. The coupling bracket 24 and the steering bracket 15 can be coupled with each other via a coupling pin 25. However, other configurations can also be used.

As a result, as the electric motor 20 can be actuated to move in the width or "transverse" direction of the watercraft relative to the threaded rod 21, the outboard motor 12 will pivot about the swivel shaft 14 via the coupling bracket 24 and the steering bracket 15.

On the other hand, as shown in FIG. 1, the steering wheel 17 can be fixed to a steering wheel shaft 26. At the proximal end of the steering shaft 26, there can be provided a steering wheel control unit 27. In some embodiments, the steering wheel control unit 27 can include a steering wheel operation angle sensor 28 configured to detect an operation angle of the steering wheel 17, and a reaction motor 29, which can serve as an "electric actuator", and which can be configured to apply a desired reaction force to the steering wheel 17 during an operation of the steering wheel 17 by the operator.

The steering wheel control unit 27 can be connected to an electronic control unit (ECU) 33, which can serve as a "control means", via a signal cable 30. The control unit 33 can be connected to the electric motor 20 of the steering device 16. The control unit 33 can be configured to receive a signal from the steering wheel operation angle sensor 28, to control the electric motor 20, the reaction motor 29, and an engine of the outboard motor 12.

Figure 4:
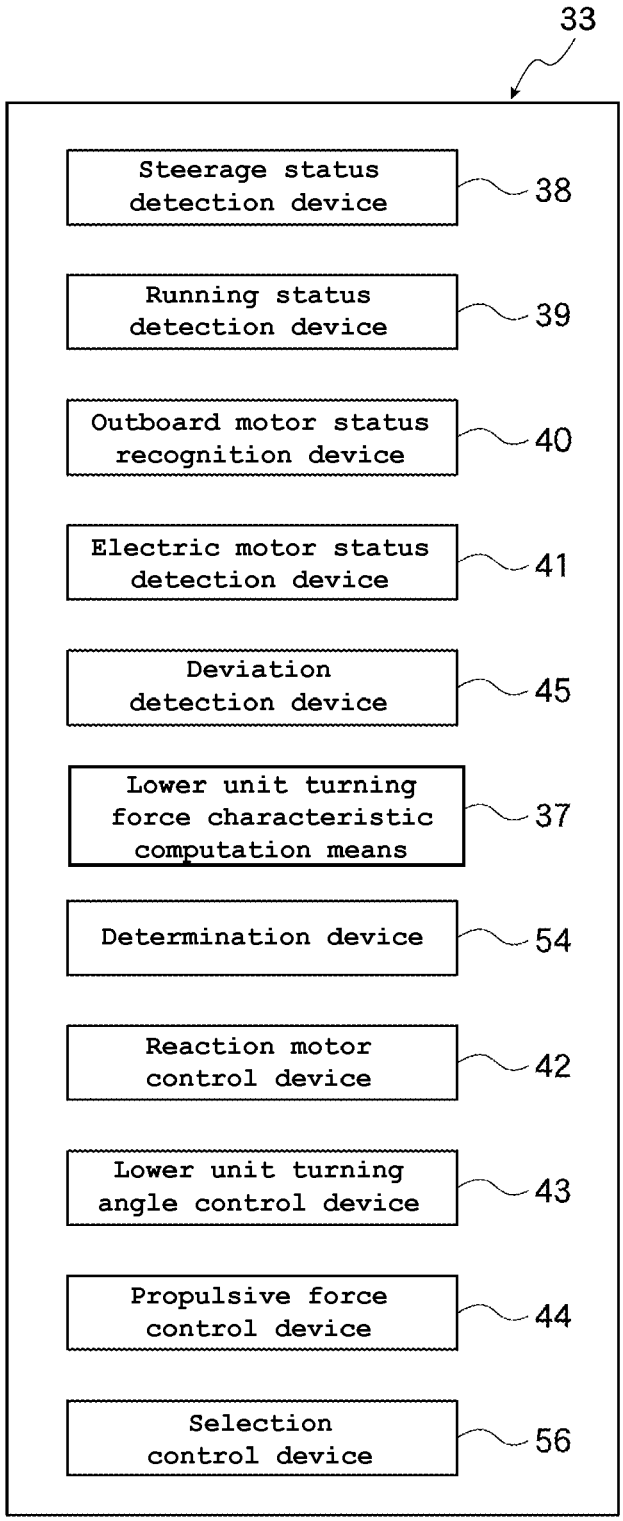
FIG. 4 is a block diagram of an ECU according to an embodiment.

As shown in FIG. 4, the control unit 33 can be provided with a steerage status detection device 38 configured to detect a steerage status corresponding to an operator's steering wheel operation, a running status detection device 39 configured to detect a running status of the watercraft, an outboard motor status recognition device 40, which can serve as "watercraft propulsion unit status recognition means", and which can be configured to recognize a status of the outboard motor 12 such as its installation number, and an electric motor status detection device 41, which can serve as "electric actuator status detection means" and which can be configured to detect a status of the electric motor 20.

The control unit 33 can also include a lower unit turning force characteristic computation device 37 configured to compute a lower unit turning force characteristic based on detection values from those devices 38 and the like, a reaction motor control device 42, which can serve as "reaction actuator control means" and which can be configured to control a reaction force to the steering wheel 17, a lower unit turning angle control device 43 which can be configured to reduce a limit of the lower unit turning angle, a propulsive force control device 44 which can be configured to control a propulsive force, and a selection control device 56 which can be configured to select the electric motor 20 to be operated.

Figure 3:
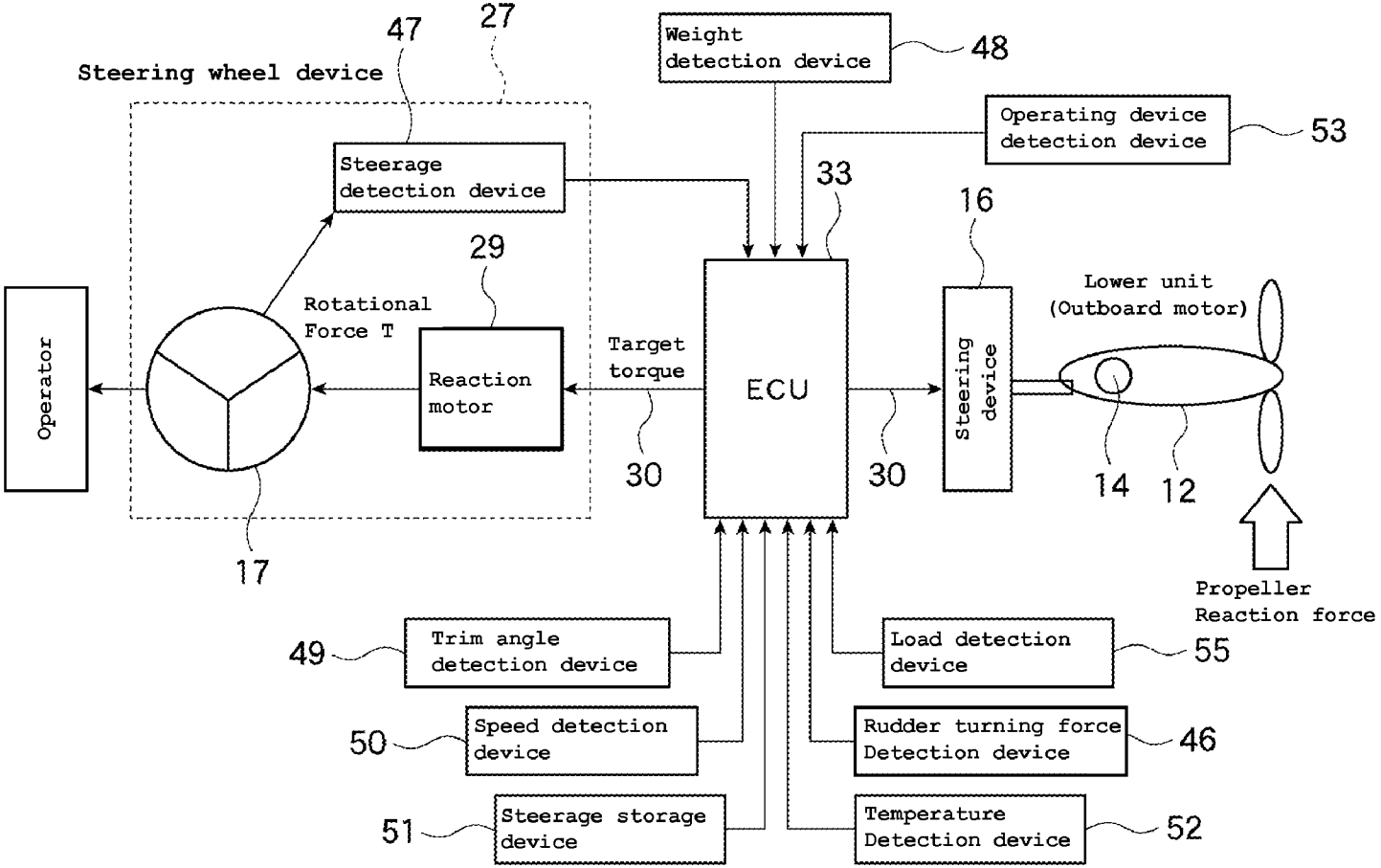
FIG. 3 is a block diagram of the watercraft according to the embodiment.

As shown in FIG. 3, the steerage status detection device 38 can be connected to a lower unit turning force detection device 46 which can be configured to detect a lower unit turning force sufficient to turn the lower unit, a load detection device 55 which can be configured to detect a load acting on the lower unit, a steerage detection device 47 which can be configured to detect a steering wheel steerage angle, a steering wheel steerage speed, a direction in which the steering wheel is operated, a lower unit turning angle, a lower unit turning speed, and a direction in which the lower unit can be turned, corresponding to the operation of the steering wheel. The steerage status detection device 38 can also be connected to deviation detection device 45 which can be configured to detect a deviation of a detected actual lower unit turning angle from a target lower unit turning angle corresponding to the steering wheel operation, as shown in FIG. 4. The steering wheel steerage angle sensor 28 provided in the steerage detection device 47 can be configured to detect a steerage angle.

As shown in FIG. 3, the running status detection device 39 can be connected to weight detection device 48 which can be configured to detect a draft position and a weight of the watercraft, trim angle detection device 49 which can be configured to detect a trim angle of the watercraft, speed detection device 50 which can be configured to detect a speed, an acceleration and a propulsive force of the watercraft, and an output of the outboard motor 12, and PTT actuation status detection device (not shown) which can be configured to detect a PTT actuation status.

Further, the outboard motor status recognition device 40 can be connected to steerage storage device 51 which can be configured to store therein information about an installation number of the outboard motor 12, an installation position of the outboard motor 12 relative to the watercraft, a rotational direction, a size, and a shape of a propeller provided in the outboard motor 12, a trim tab angle, a trim tab shape, and the like. In some embodiments, the steerage storage device 51 can be included in the ECU 33.

In addition, the electric motor status detection device 41 can be connected to temperature detection device 52 which can be configured to detect a temperature of the electric motor 20, and operating device detection device 53 which can be configured to detect a number of the electric motor 20 in operation among a plurality of the electric motors 20 and which electric motor 20 is in operation in the case that a plurality of the outboard motors 12 are mounted and a plurality of the electric motors 20 are provided, and so forth.

During operation, when an operator first turns the steering wheel 17 by a certain amount in a certain direction, a signal can be sent from the steering wheel steerage angle sensor 28 of the steerage detection device 47 to the ECU 33. A target lower unit turning angle can be detected by the steerage status detection device 38, and a deviation between the target lower unit turning angle and an actual angle of the lower unit (target control deviation) can be computed.

Figure 5:
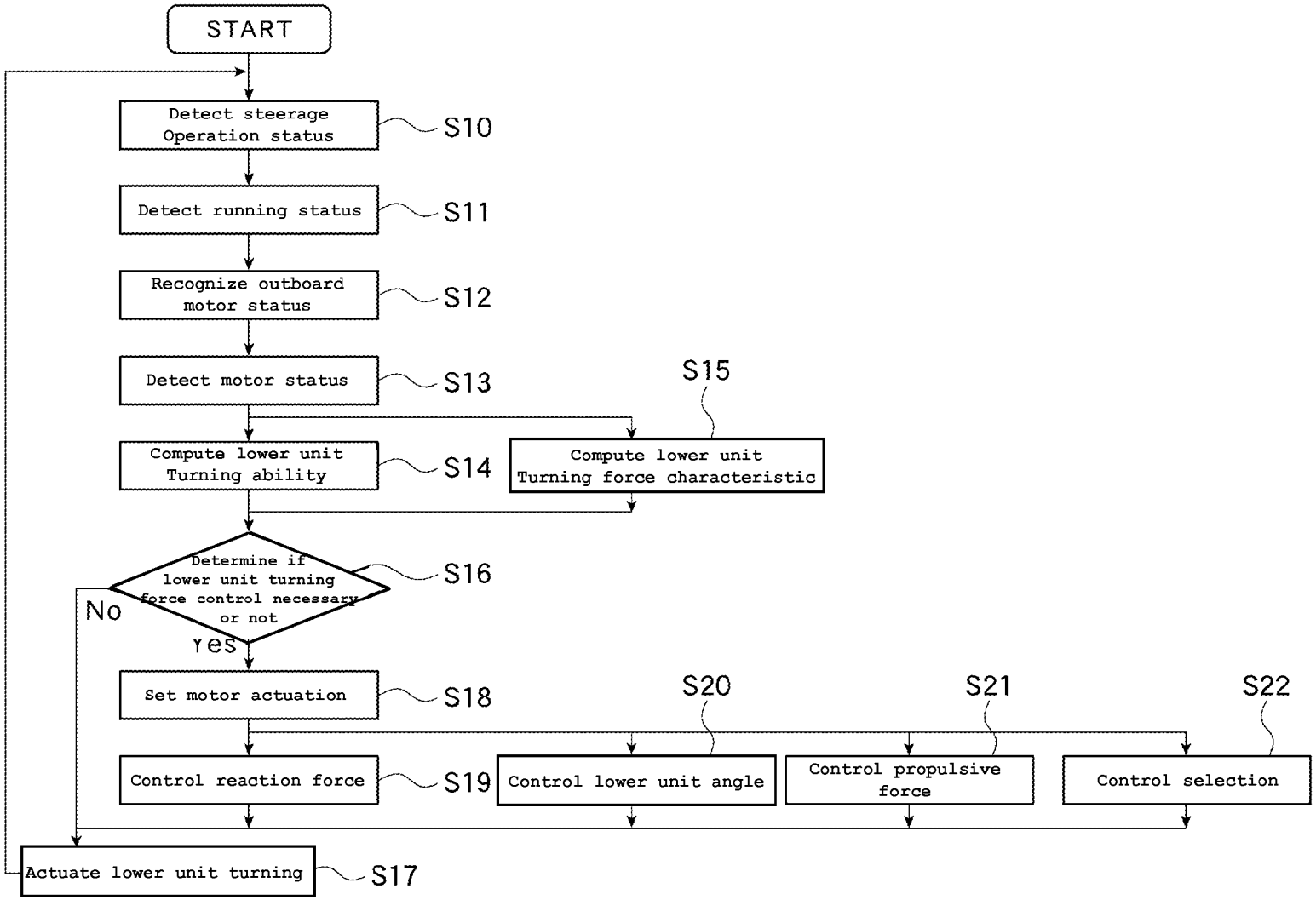
FIG. 5 is a flowchart of a reaction control process in accordance with an embodiment.

A steerage status can be detected by the steerage status detection device 38 in step S10 in FIG. 5. A steerage status, as used herein, can refer to statuses such as a required lower unit turning force corresponding to an operation of the steering wheel, a load acting on the lower unit (the outboard motor 12), a steering wheel steerage angle, a steering wheel steerage speed, a direction in which the steering wheel is operated, a lower unit (the outboard motor 12) turning angle, a lower unit turning speed, and a direction in which the lower unit is turned, corresponding to the operation of the steering wheel, a deviation mentioned above, and so forth.

A lower unit turning force required for a lower unit turning corresponding to an operation of the steering wheel can be detected by the lower unit turning force detection device 46. Load acting on the lower unit can be detected by the load detection device 55.

A steering wheel steerage angle, a steering wheel steerage speed, a direction in which the steering wheel is operated, a lower unit turning angle, a lower unit turning speed, a direction in which the lower unit is turned, corresponding to the operation of the steering wheel, can be detected by the steerage detection device 47. Those detection signals can be sent to the steerage status detection device 38, and thereby a steerage status can be detected.

A running status can be detected by the running status detection device 39 in step S11. A running status, as used herein, can refer to statuses such as a draft position, a weight and a trim angle of the watercraft, a speed, an acceleration, a deceleration and a propulsive force of the watercraft, and an output of the outboard motor 12, and so forth.

Further, the draft position and the weight of the watercraft can be detected by the weight detection device 48. A trim angle of the watercraft can be detected by the trim angle detection device 49. The speed, the acceleration, the propulsive force of the watercraft and the output of the outboard motor 12 can be detected by the speed detection device 50. Those detection signals can be sent to the running status detection device 39, and thereby a running status can be detected.

In addition, a status of the outboard motor 12 can be recognized by the outboard motor status recognition device 40 in step S12. A status of the outboard motor means statuses such as an installation number of the outboard motor 12, an installation position of the outboard motor 12 relative to the watercraft, a rotational direction of the propeller provided in the outboard motor 12, a propeller size, a propeller shape, a trim tab angle and a trim tab shape, and so forth.

Information about an installation number of the outboard motor 12, an installation position of the outboard motor 12 relative to the watercraft, and the rotational direction of the propeller provided in the outboard motor 12 can be stored in the steerage storage device 51. This information can be read out and sent to the outboard motor status recognition device 40, and thereby a status of the outboard motor 12 can be recognized.

Next, a status of the electric motor 20 can be detected by the electric motor status detection device 41, for example, in step S13. A status of the electric motor 20 can be a status of a factor which has an effect on an output characteristic of the electric motor 20. This "status" can refer to statuses such as a temperature and a voltage of the electric motor 20, and a number of the electric motor in operation or which actuation motor 20 is in operation, and so forth.

A temperature of the electric motor 20 can be detected by the temperature detection device 52. Information about a number of the electric motor 20 in operation and which electric motor 20 is in operation can be detected by the operating device detection device 53. Those detection signals can be sent to the electric motor status detection device 41, and thereby a status of the electric motor 20 can be detected.

In step S14, a turning ability can be calculated, based on the ability of the electric motor 20 to turn the lower unit. For example, a signal from the electric motor status detection device 41 can be used to calculate a turning ability. However, other signals can also be sued. Also, in step S15, a lower unit turning force characteristic can be computed by the lower unit turning force characteristic computation device 37 with signals from the steerage status detection device 38 and the running status detection device 39, and so forth. However, other signals can also be used.

In step S16, whether lower unit turning control is necessary can be determined by a determination device 54. For example, in step S16, if the determination device 54 determines that a lower unit turning ability of the electric motor 20 computed in step S14 satisfies a lower unit turning force characteristic sufficient to turn the lower unit computed in step S15, the determination is "NO" because a control is not necessary. After Step S16, the process goes to step S17, in which a lower unit turning actuation can be made and then the process returns to step S10.

On the other hand, in step S16, if it is determined that a lower unit turning ability of the electric motor 20 computed in step S14 does not satisfy a lower unit turning force characteristic required for a lower unit turning computed in step S15, the determination is "YES" because a control is necessary. The process can move on to step S18, and a motor actuation setting of the reaction motor 29, the electric motor 20, the engine and the like can be made.

In step S19, the reaction motor 29 can be actuated and a reaction force control can be made. In step S20, an actuation length (e.g., time) of the electric motor 20 can be controlled and a lower unit turning angle can be controlled. In step S21, a propulsive force of the engine of the outboard motor 12 can be controlled. Further, in step S22, a control for selecting the electric motor 20 to operate can be made. Then, the process can move on to step S17, a lower unit turning actuation can be made, and the process can return to step S10.

Thereby, a reaction force control, a lower unit turning angle control, a propulsive force control, and a selection control of the electric motor 20 can be made corresponding to a running status and so forth of the watercraft as an operator operates. Therefore, an actuation of the electric motor 20 can be constantly effective, and an operator can steer with an excellent operation feeling.

For example, a control corresponding to a steerage status can be made so that a reaction force can be larger, a limit turning force can be smaller, a propulsive force can be smaller, or a number of the electric motors 20 can be larger, or the electric motors 20 with a larger output can be selected as a steerage speed can be faster or a steerage angle can be larger.

Usually, a required turning load becomes larger as a steerage speed is faster in the watercraft steering device in which the steering wheel 17 is connected to the outboard motor 12 by a mechanical cable. Therefore, in some embodiments, corresponding to such a situation, a control can be made so that a reaction force can be large, a limit turning angle can be small, a propulsive force can be small, or a number of the electric motors 20 to operate can be large, or the electric motors 20 with a large output can be selected.

Figure 6:
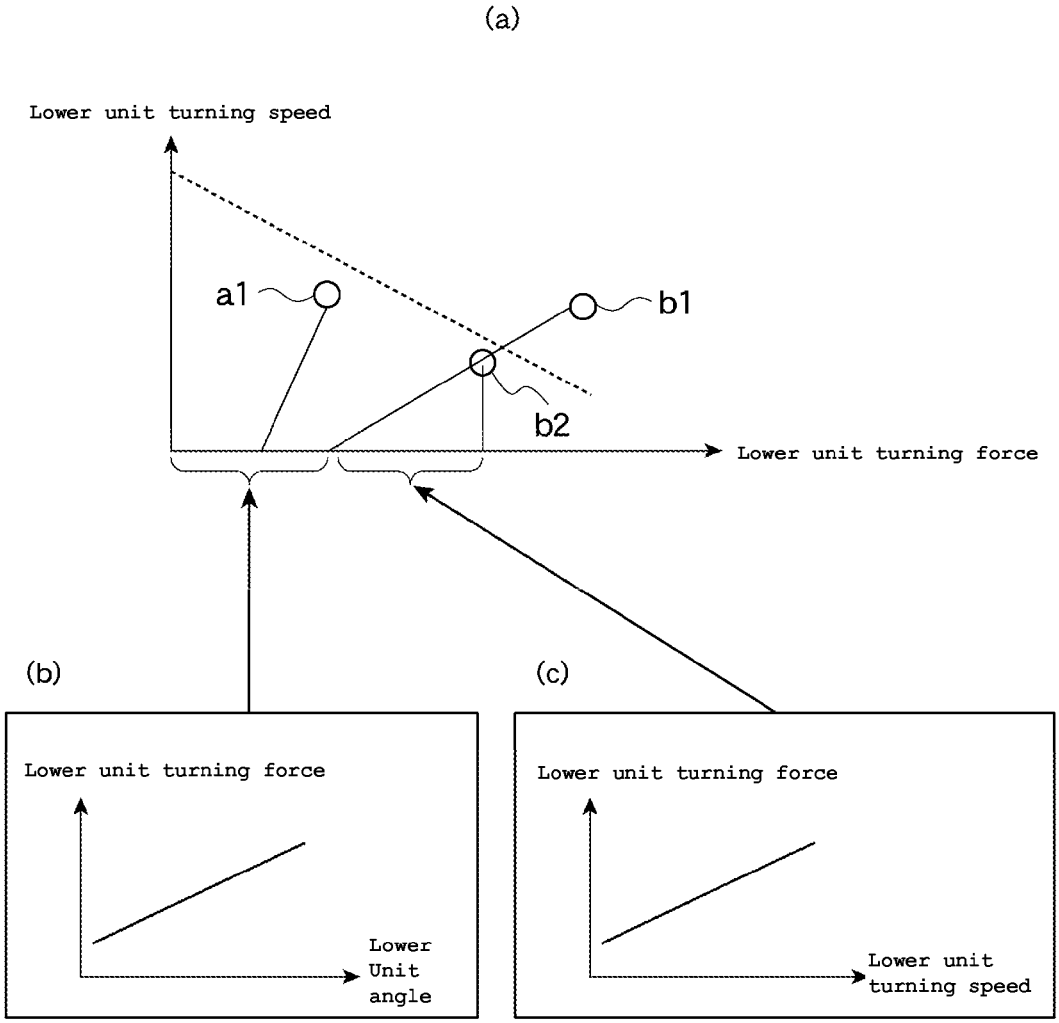
FIGS. 6(*a*), 6(*b*), and 6(*c*) are graphs showing exemplary relationships between lower unit turning speeds and lower unit turning forces.

In some embodiments, with reference to FIG. 6, the relationship between lower unit turning force and lower unit angle can be a proportional relationship such that a lower unit turning force increases as a lower unit angle increases as shown in (b). The relationship between lower unit turning force and lower unit turning speed can be a proportional relationship such that a lower unit turning force increases as a lower unit turning speed increases as shown in (c). In the case of (b), or the case of (c) and the relationship between lower unit turning speed and lower unit turning force can be set in a manner that the broken line in (a) represents the lower unit turning ability characteristic line, a reaction force of the steering wheel 17 does not have to be increased more than a present size if a lower unit angle can be value a1 and inside the area of the lower unit turning ability characteristic line, and lower unit turning responsiveness can be assured.

On the other hand, if a lower unit turning speed can be value b1 and outside the area of the lower unit turning ability characteristic line, lower unit turning responsiveness can be assured by increasing a reaction force of the steering wheel 17 and thereby making the value fall inside the area of the lower unit turning ability characteristic line as shown by value b2 in FIG. 6(*a*).

Figure 7:
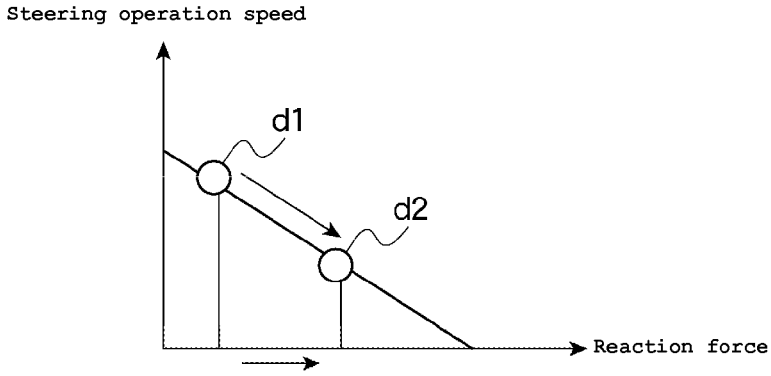
FIGS. 7(*a*), 7(*b*), and 7(*c*) are graphs of exemplary effects of a reaction control according to an embodiment.
Figure 7:
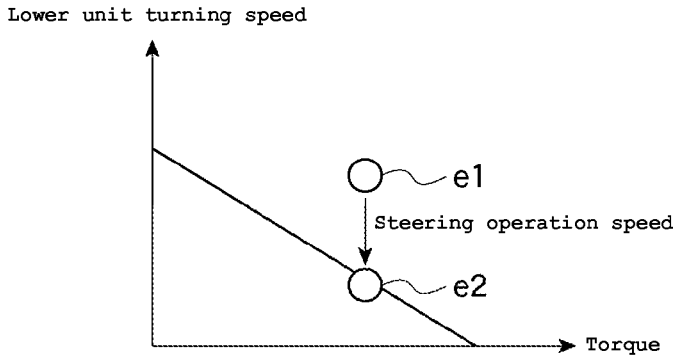
Figure 7:
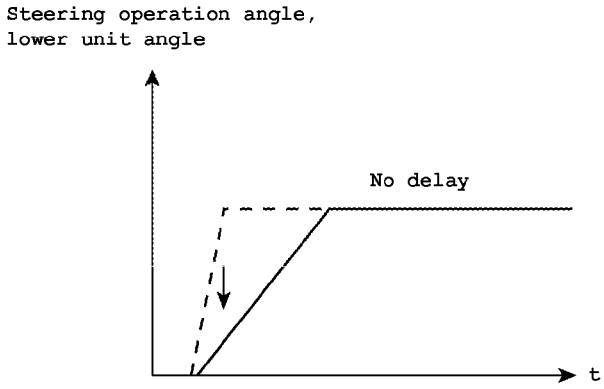

That is, if a reaction force value is increased from d1 to d2 as shown in FIG. 7(*a*), a steerage speed of the steering wheel 17 slows down from d1 to d2, and thereby a steerage speed can be slowed down from e1 to e2 as shown in FIG. 7(*b*).

As a result, as shown in FIG. 7(*c*), a steerage angle (lower unit angle) sharply changes about time t as shown by the broken line in the figure in an operation of the steering wheel 17 in a conventional situation that a reaction force is not controlled. However, a reaction force is increased as mentioned above, and thereby a change of steerage angle (lower unit angle) about time t is mild as shown by the solid line in the figure.

In some embodiments, a control corresponding to a running status can be made so that a reaction force can be large, a limit lower unit turning angle can be small, a propulsive force can be small, or a number of the electric motors 20 to be operated can be large, or the electric motors 20 with a large output can be selected when the watercraft is cruising at a high speed, the watercraft is heavy, the watercraft is in a trim in state, the watercraft is accelerating or decelerating, or the like.

In the a watercraft steering device in which the steering wheel 17 is connected to the outboard motor 12 by a mechanical cable, a required lower unit turning load increases when the watercraft is cruising at a high speed, the watercraft is heavy, the watercraft is in a trim in state, the watercraft is accelerating or decelerating, or the like. Therefore, in some embodiments, corresponding to such a situation, a control can be made so that a reaction force can be large, a limit lower unit turning angle can be small, a propulsive force can be small, or a number of the electric motors 20 to operate can be large, or the electric motors 20 with a large output can be selected.

In some embodiments, a control corresponding to a status of the outboard motor 12 can be made so that a reaction force can be large, a limit lower unit turning angle can be small, a propulsive force can be small, or a number of the electric motors 20 to operate can be large, or the electric motors 20 with a large output can be selected. In the case that a propeller reaction force occurs in one direction due to a rotational direction of the propeller provided in the outboard motor 12, a control can be made so that a reaction force can be larger, a limit lower unit turning angle can be smaller, a propulsive force can be smaller, or a number of the electric motors 20 to be operated can be larger, or the electric motors 20 with a larger output can be selected comparing with a lower unit turning in the opposite direction when a lower unit turn can be made in the direction resisting to the propeller reaction force.

In watercraft in which the steering wheel 17 is connected to the outboard motor 12 by a cable, as shown in FIG. 3, a required lower unit turning load becomes larger in a steerage in the direction opposite to a direction that the outboard motor 12 receives a propeller reaction force than in a lower unit turning in the direction that the outboard motor 12 receives a propeller reaction force. Thus, in some embodiments, corresponding to such a situation, a control can be made so that a reaction force can be large, a limit lower unit turning angle can be small, a propulsive force can be small, or a number of the electric motors 20 to be operated can be large, or the electric motors 20 with a large output can be selected.

An installation position of the outboard motor 12 provides a different load characteristic depending on if a lower unit turning is to the left or to the right in the case that a plurality of the outboard motors 12 are mounted and the watercraft is actually running using only a part of those outboard motors 12, or in the case that a trim status of each outboard motor 12 is different (the case that the depths that lower parts of the outboard motors 12 immersed in water are different). Therefore, a reaction force, a limit lower unit turning angle and a propulsive force in a lower unit turning can be corrected corresponding to installation positions or differences in trim angles of the outboard motors 12. For example, in the case that a lower unit turning is made to a side where the outboard motor 12 with a small trim angle is mounted, a reaction force in turning the steering wheel back after a lower unit turning can be increased.

Figure 8:
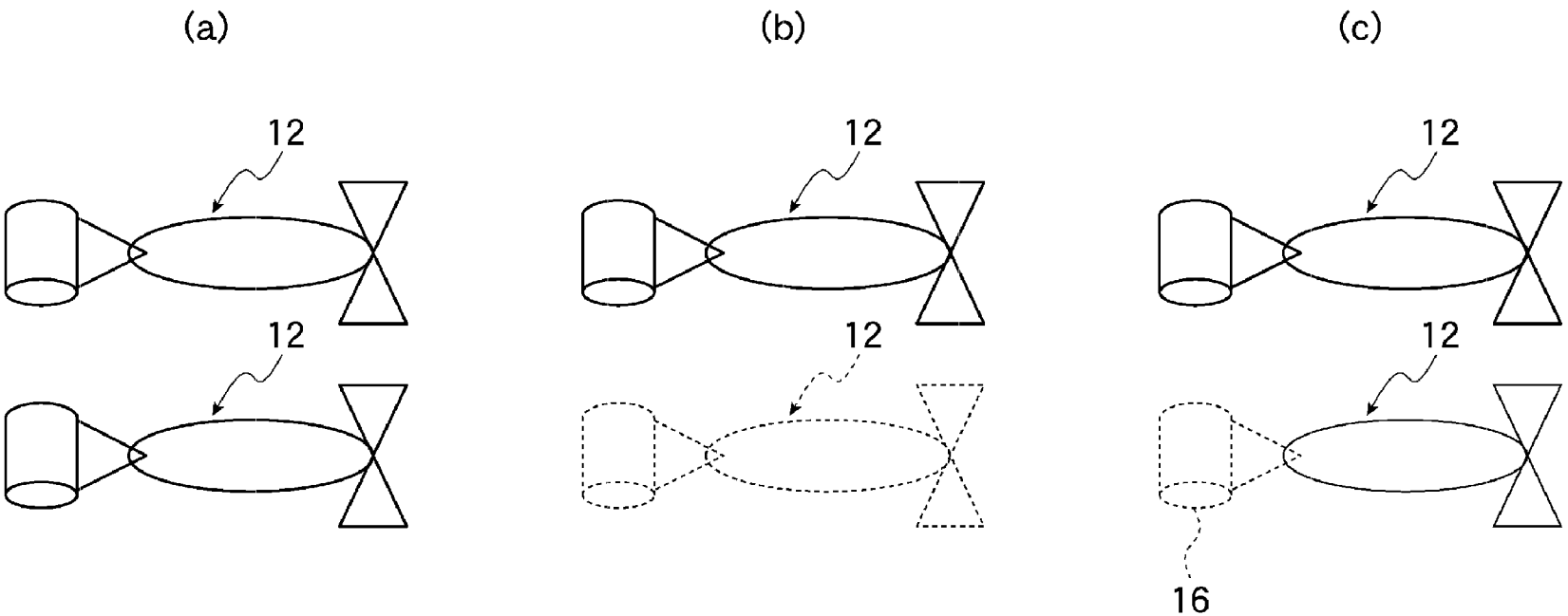
FIGS. 8(*a*), 8(*b*), and 8(*c*) are schematic views showing different states of two outboard motors according to an embodiment.
Figure 9:
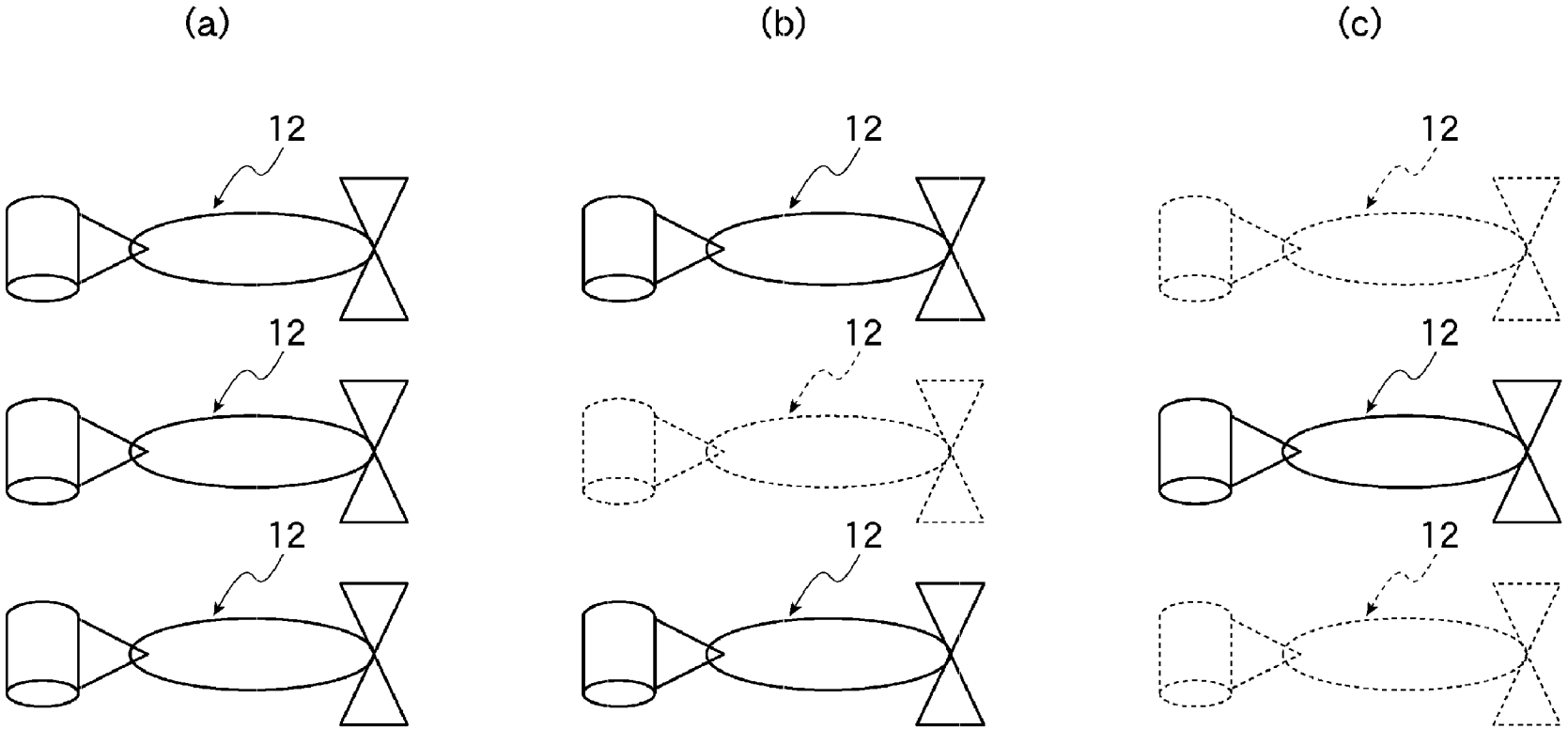
FIGS. 9(*a*), 9(*b*), and 9(*c*) are schematic views showing different states of three outboard motors according to an embodiment.

FIG. 8 schematically illustrates an embodiment in which two outboard motors 12 are mounted to a watercraft. FIG. 9 illustrates an embodiment in which three outboard motors 12 are mounted to a watercraft.

FIG. 8(*a*) shows that both of the outboard motors 12 are operating, as indicated by the solid lines in the figure. FIG. 8(*b*) shows a situation in which only one of the two outboard motors 12 is operating, as shown by the solid line in the figure, the outboard motor 12 illustrated by broken line is not operating in this figure. FIG. 8(*c*) shows a case that the steering device 16 of one of the two outboard motors 12 shown (with broken line) is out of order.

FIG. 9(*a*) shows a case that all the three outboard motors 12 are operating as shown by the solid line. FIG. 9(*b*) shows a case in which two of the three outboard motors 12 on both the sides (outboard motor 12S and outboard motor 12P) shown by the solid line are operating. FIG. 9(*c*) shows a case that one of the three outboard motors 12 in the middle (outboard motor 12C) shown by the solid line is operating.

Figure 13:
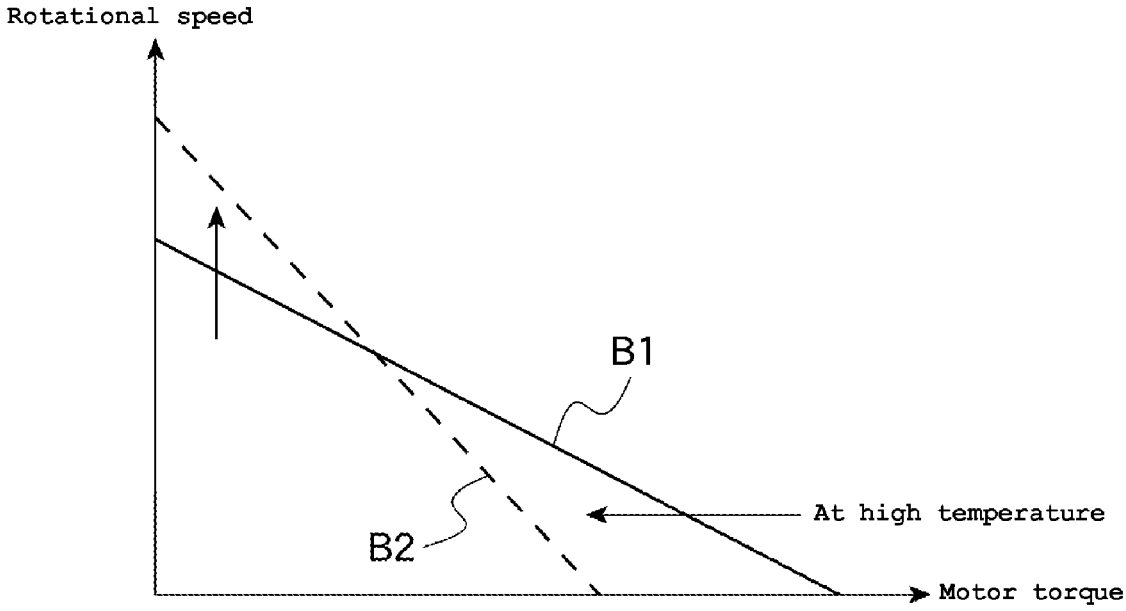
FIG. 13 is a graph of another motor characteristic showing the relationship between generated torque of the electric motor and rotational speed.

In some embodiments, in control operations corresponding to motor status, the electric motor 20 can exhibit a motor characteristic shown by the broken line in FIG. 13 mentioned above and thus less torque is output as a motor temperature rises. Therefore, to prevent a case that the electric motor 20 overshoots its ability limit, a control can be made so that a reaction force is large, a limit lower unit turning angle is small, a propulsive force is small, or a number of the electric motors 20 to operate is large, or the electric motors 20 with a large output is selected.

In the case that a plurality of the electric motors 20 are used, a reaction force can be made larger, a limit lower unit turning angle can be made smaller, and a propulsive force can be made smaller as a number of the electric motor that can operate among those electric motors 20 can be less so that the electric motor 20 does not overshoot its ability limit.

As described above, the steering wheel 17 can be operated lightly because a lower unit turning of the outboard motor 12 is operated with the electric motor 20 in the watercraft. However, if the lower unit is excessively turned for example, a larger load can be required in turning the lower unit back than in turning the lower unit to a certain side. Therefore, an output from the electric motor 20 becomes less responsive, and an operation feeling of a lower unit turning action may be deteriorated. However, in some embodiments, a reaction force can be made large, a limit lower unit turning angle can be made small, and a propulsive force can be made small corresponding to a motor characteristic of the electric motor 20, and thereby a limit of the motor characteristic can be not exceeded in turning the lower unit back. Thus, an operation feeling of a lower unit turning action is not deteriorated in turning the lower unit back because the outboard motor 12 can be steered in an output range of the electric motor 20.

Figure 10:
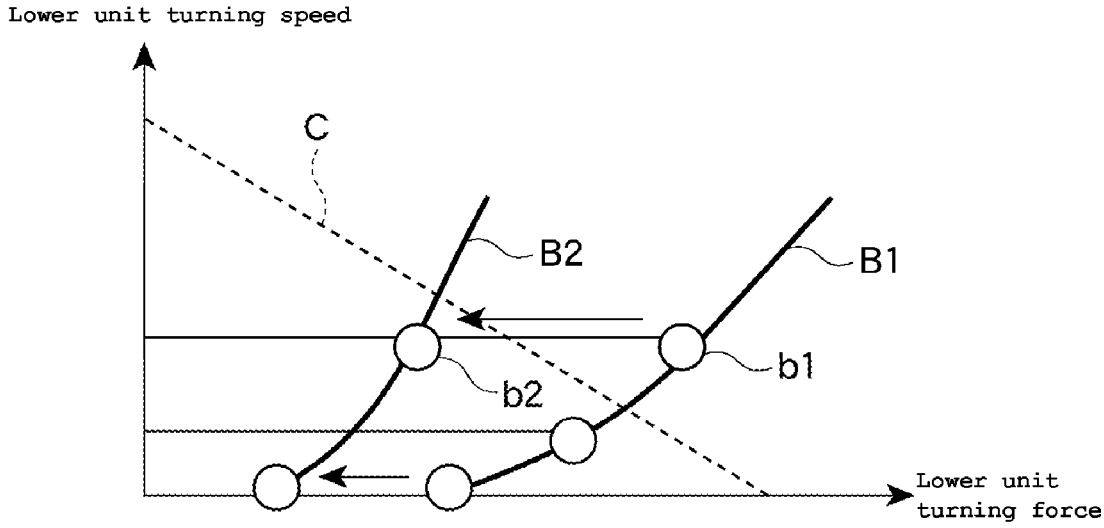
FIGS. 10(*a*) and 10(*b*) are graphs illustrating exemplary relationships between lower unit turning speed and lower unit turning force (FIG. 10(*a*)) and between lower unit turning force and lower unit turning angle (FIG. 10(*b*)), in accordance with an embodiment.
Figure 10:
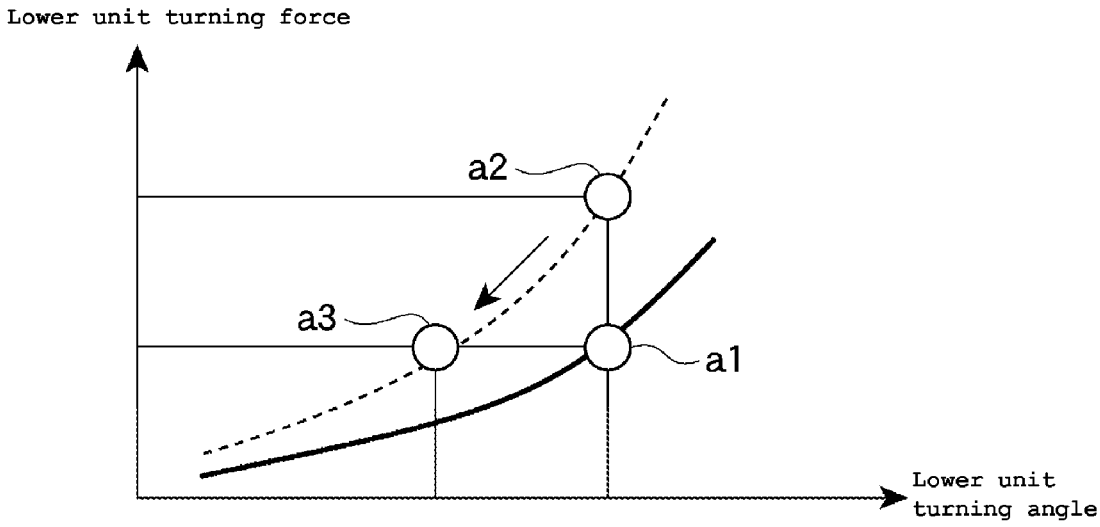

For example, as shown in FIG. 10(*b*), the relationship between lower unit turning angle and lower unit turning force changes from a characteristic shown by the solid line in the figure to a characteristic shown by the broken line in the figure as variables such as a watercraft speed, a trim angle, a weight, an acceleration, a deceleration and so forth in a running status, an electric motor status and so forth increase. In some situations, a certain lower unit turning angle corresponding to position a1 on a characteristic line represented by the solid line corresponds to position a2 on a characteristic line represented by the broken line, and a lower unit turning force becomes larger to correspond to position a2. A certain lower unit turning force corresponding to position a1 on the characteristic line represented by the solid line corresponds to position a3 of the characteristic represented by the broken line, and a lower unit turning angle becomes smaller to correspond to position a3.

If a lower unit turning force and so forth become larger in such a case and a limit lower unit turning angle is large, a value may fall outside of the area of ability characteristic line C of the electric motor 20 as shown by position b1 on characteristic line B1 in FIG. 10(*a*) that shows the relationship between lower unit turning force and lower unit turning speed. In such a case, a limit lower unit turning angle can be controlled by a small amount, and thereby a motor characteristic can be changed as characteristic line B2. As shown by position b2, a lower unit turning force becomes smaller at a lower unit turning speed corresponding to position b1, and falls inside the area of ability characteristic line C. Therefore, the outboard motor 12 can be steered in the output area of the electric motor 20, and thereby a response delay to a lower unit turning action does not occur or is smaller.

On the other hand, in a selection control of the electric motor 20, a computation can be made corresponding to a status of each electric motor 20, and, at the same time, a computation can be made to obtain a lower unit turning force characteristic in the case that a plurality of the electric motors 20 are selected from the electric motors 20 that can operate among the electric motors 20. The electric motor 20 and its operating number can be selected such that a lower unit turning ability exceeds a required lower unit turning force characteristic.

Figure 11:
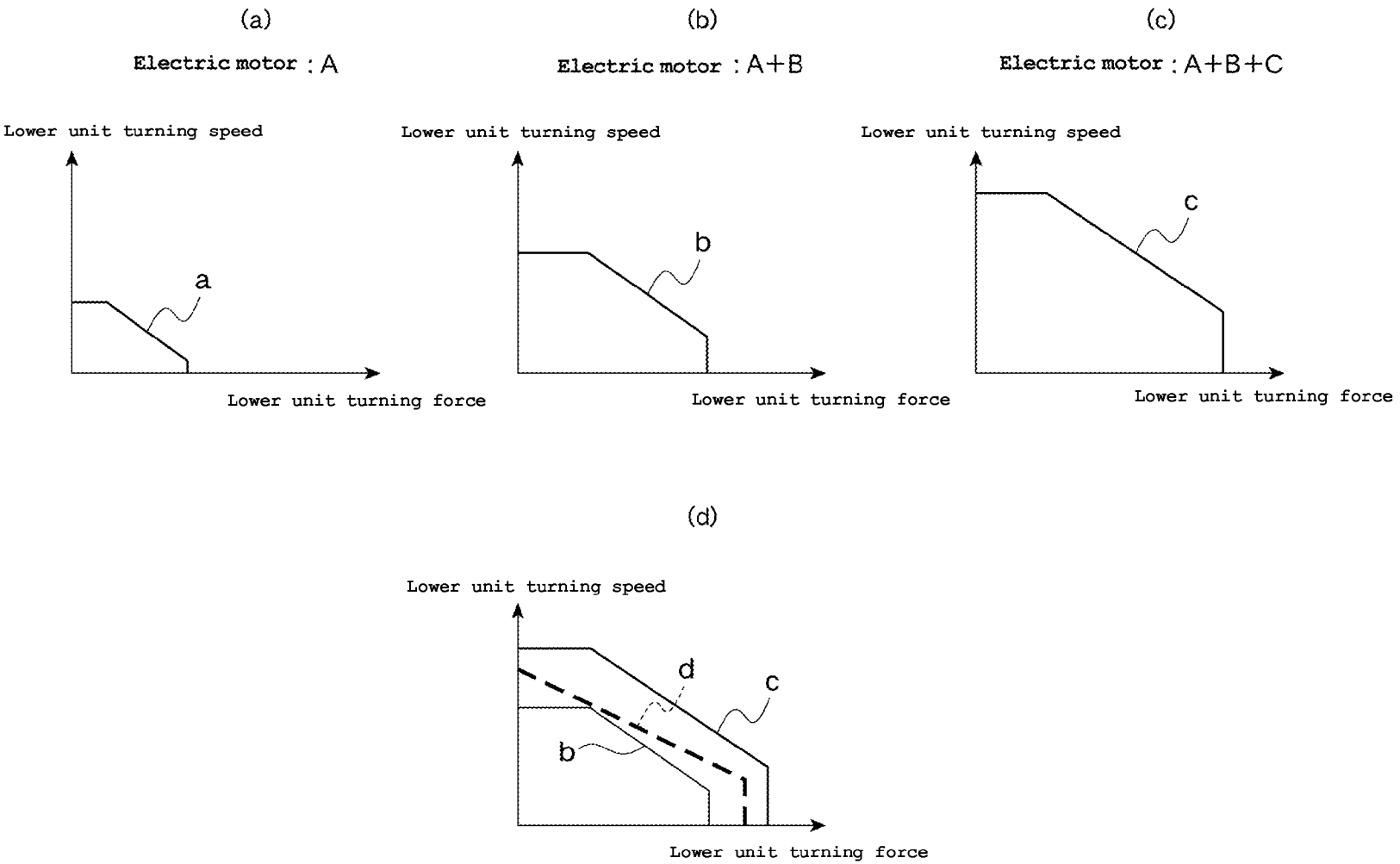
FIGS. 11(*a*), 11(*b*), and 11(*c*) are graphs illustrating exemplary relationships between lower unit turning speed and lower unit turning force based on a computation result of a lower unit turning ability and FIG. 11(*d*) illustrated an exemplary relationship between lower unit turning speed and lower unit turning force based on a selection of an electric motor.
Figure 12:
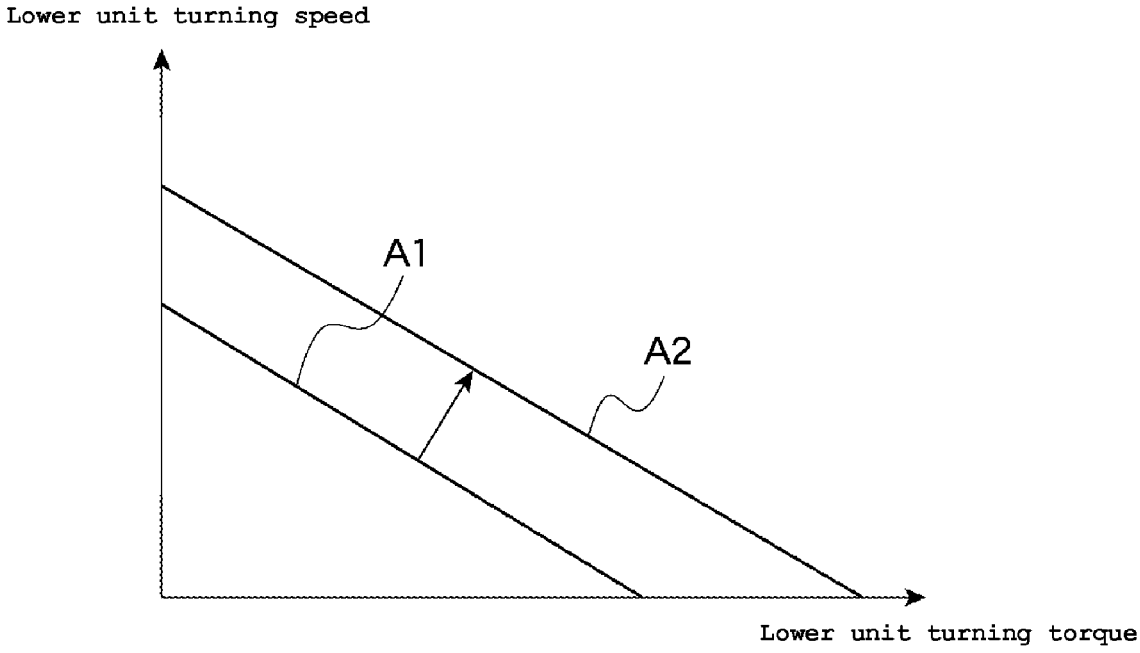
FIG. 12 is a graph of another required lower unit turning force characteristic showing the relationship between lower unit turning torque and lower unit turning speed.

For example, in the case that a lower unit turning force of an electric motor A, a lower unit turning force of electric motors A+B, and a lower unit turning force of electric motors A+B+C are computed as shown by characteristic line a in FIG. 11(*a*), characteristic line b in FIG. 11(*b*), and characteristic line c in FIG. 11(*c*), respectively, and a required lower unit turning force characteristic can be computed as shown by characteristic line d in FIG. 11(*d*), a lower unit turning characteristic shown in FIGS. 11(*a*), (*b*) and (*c*) can be compared with a required lower unit turning force characteristic shown in FIG. 11(*d*), and thereby a control can be made so that, here, the lower unit turning force characteristic exceeds the required lower unit turning force characteristic, that is, the electric motors A+B+C operate as shown by characteristic line c in FIG. 11(*c*).

It is a matter of course that while in the foregoing embodiments, the outboard motor 12 can be used as the "watercraft propulsion unit," the present inventions are not limited to such embodiments, but they may include inboard/outboard motors or other types of propulsion devices. Further, the foregoing embodiments include the steerage status detection device 38, the running status detection device 39, the outboard motor status recognition device 40 and the electric motor status detection device 41. The embodiments, disclosed above can operate with only one, or any combination of two or more of these devices.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A boat steering device comprising:

a boat propulsion unit arranged to be disposed at a stern of a boat, the boat propulsion unit including a lower unit disposed under water;

a steering device including an electric actuator to change a direction in which the boat travels;

a steering wheel operable by an operator and electrically connected to the electric actuator to provide an actuation signal corresponding to an operation amount of the electric actuator;

a steering status detection device to detect an operation amount of the steering wheel;

an electric actuator status detection device to detect the operation amount of the electric actuator;

a turning force computation device to compute a turning force required to turn the lower unit based on at least the detected operation amount of the steering wheel; and a control unit to control at least one parameter of the boat when the turning force required to turn the lower unit exceeds the operation amount of the electric actuator.

2. The boat steering device according to claim 1, wherein the at least one parameter includes a reaction force to the steering wheel, a lower unit turning angle, a propulsive force of the boat propulsion unit, and a selection of the electric actuator; and the control unit includes a reaction force control unit to control the reaction force to the steering wheel, a lower unit turning angle control unit to control the lower unit turning angle, a propulsive force control unit to control the propulsive force of the boat propulsion unit, and a selection control device to control the selection of the electric actuator.

3. The boat steering device according to claim 1, wherein the control unit includes a running status detection unit to detect a running status of the boat.

4. The boat steering device according to claim 3, wherein the running status detection unit includes at least one of a weight detection unit to detect at least one of a draft position and a weight of the boat, a trim angle detection unit to detect a trim angle of the boat, and a speed detection unit to detect at least one of a speed, an acceleration, a propulsive force of the boat, and an output of the boat propulsion unit.

5. The boat steering device according to claim 1, wherein the control unit includes a boat propulsion unit status recognition unit to recognize a status of the boat propulsion unit.

6. The boat steering device according to claim 5, wherein the boat propulsion unit status recognition unit includes a steerage storage device to store therein any one of information among a plurality of the boat propulsion units installed on the boat, an installation position of the boat propulsion unit, a rotational direction of a propeller provided in the boat propulsion unit, a propeller shape, a trim tab angle, and a trim tab shape.

7. The boat steering device according to claim 1, wherein the electric actuator status detection device includes at least one of a temperature detection unit to detect a temperature of the electric actuator, and an operating device detection unit to detect a number of the electric actuators in operation.

8. The boat steering device according to claim 1, wherein the steering status detection device includes a lower unit turning force detection unit to detect the lower unit turning force required to turn the lower unit, and a load detection unit to detect a load acting on the lower unit.

9. The boat steering device according to claim 1, wherein the steering status detection device detects a steering wheel steering angle, a steering wheel steering speed, a direction in which the steering wheel is operated, a lower unit turning speed, and a direction in which the lower unit is turned.

10. The boat steering device according to claim 1, wherein the steering status detection device includes a deviation detection unit to detect a deviation between a target lower unit turning angle corresponding to the operation amount of the steering wheel and an actual lower unit turning angle.

11. A boat comprising:

the boat steering device according to claim 1.

* * * * *